US005748073A

United States Patent [19]

Crawford

[11] Patent Number: 5,748,073

[45] Date of Patent: May 5, 1998

[54] ELECTRONIC GOAL DETECTOR

[76] Inventor: James D. Crawford, 6821 176th Street, Surrey, B.C., Canada, V3S 4G6

[21] Appl. No.: 865,609

[22] Filed: May 29, 1997

[51] Int. Cl.[6] ..... G08B 23/00

[52] U.S. Cl. ..... 340/323 R; 473/471; 273/392; 273/57.2; 273/354

[58] Field of Search ..... 340/323 R; 273/371, 273/377, 381, 382, 391, 392; 473/471

[56] References Cited

U.S. PATENT DOCUMENTS

| | | | |
|---|---|---|---|
| 4,842,283 | 6/1989 | LeBel et al. | 273/392 |
| 5,249,797 | 10/1993 | Dowhy | 273/57.2 |
| 5,356,135 | 10/1994 | Montgomery | 273/57.2 |
| 5,498,000 | 3/1996 | Cuneo | 273/354 |
| 5,615,880 | 4/1997 | Booth et al. | 473/471 |

*Primary Examiner*—Jeffery Hofsass
*Assistant Examiner*—Toan Pham

[57] ABSTRACT

A new electronic goal detector for accurately detects and signals when a hockey puck passes through the goal line between the goal posts of a hockey goal. The inventive device includes a set of goal sensors for mounting on the goal posts and cross bar of a hockey goal to act as a goal sensing means for detecting a puck passing through the goal line. A goal sensor is also embedded within the hockey playing surface along the goal line. At the bottom end of one of the goal posts is a two-part connector that separates when the hockey goal is moved off of the goal line to deactivate the goal sensors. A sound generating device and a light source provide an indicating means for indicating when a puck passes into the hockey goal.

10 Claims, 3 Drawing Sheets

FIG 1
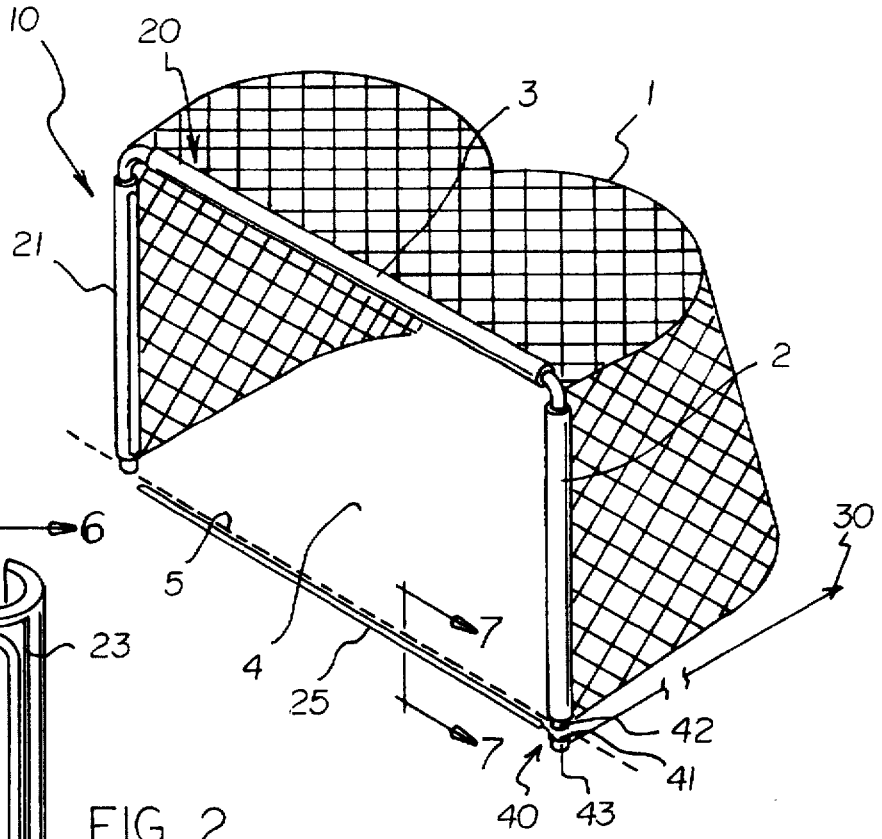
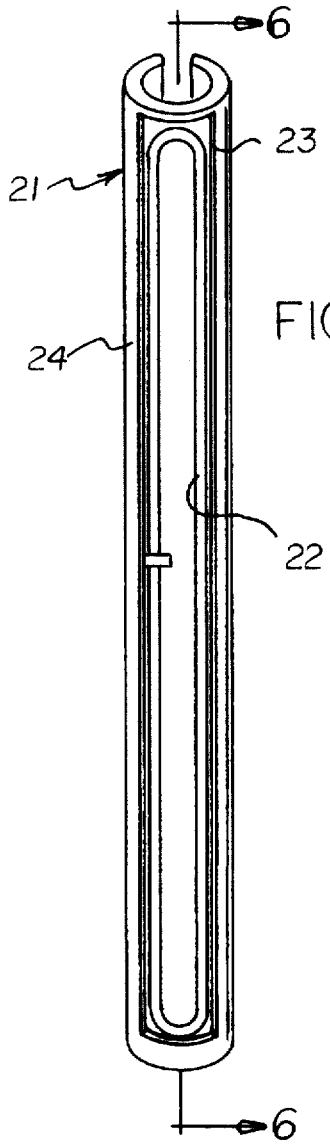
FIG 2
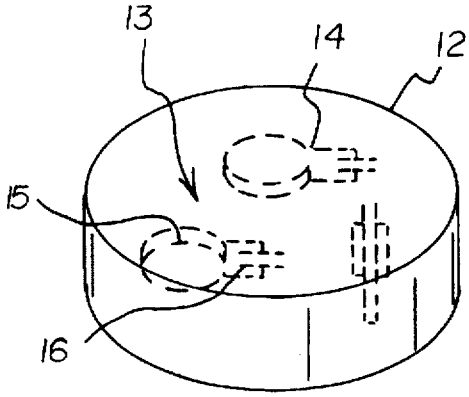
FIG 3

FIG 4
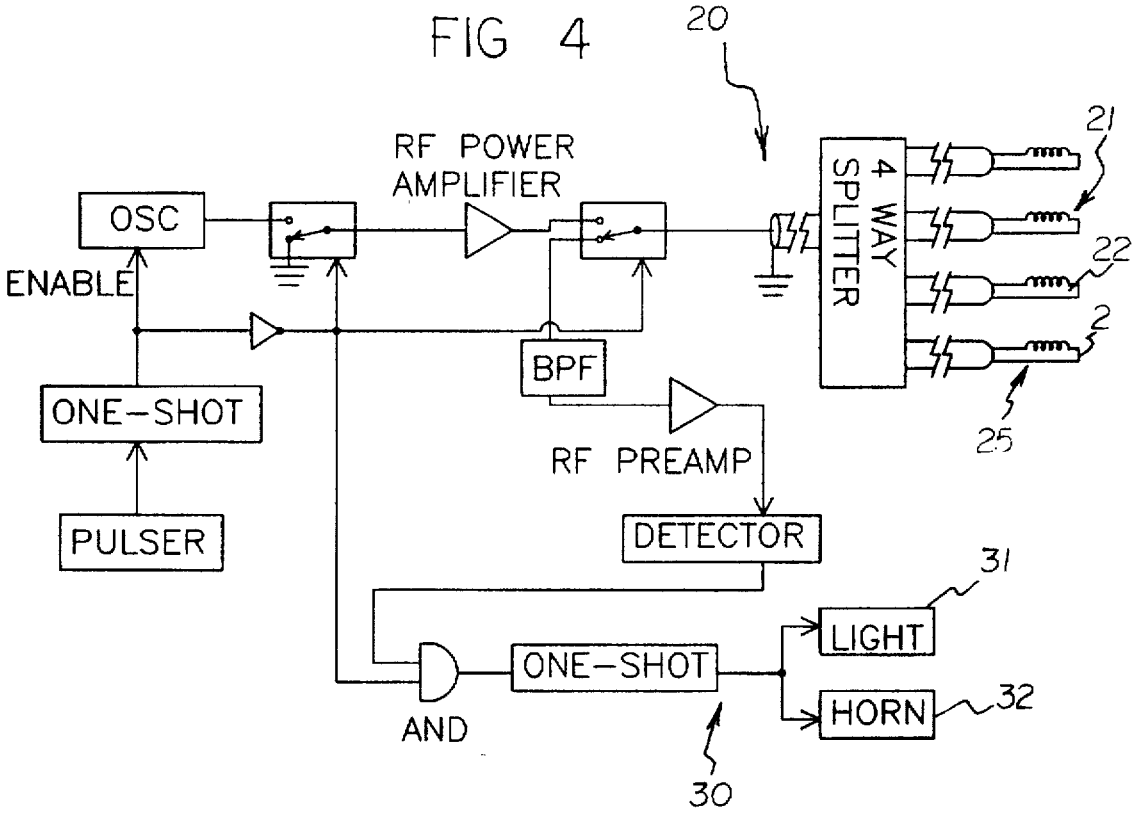
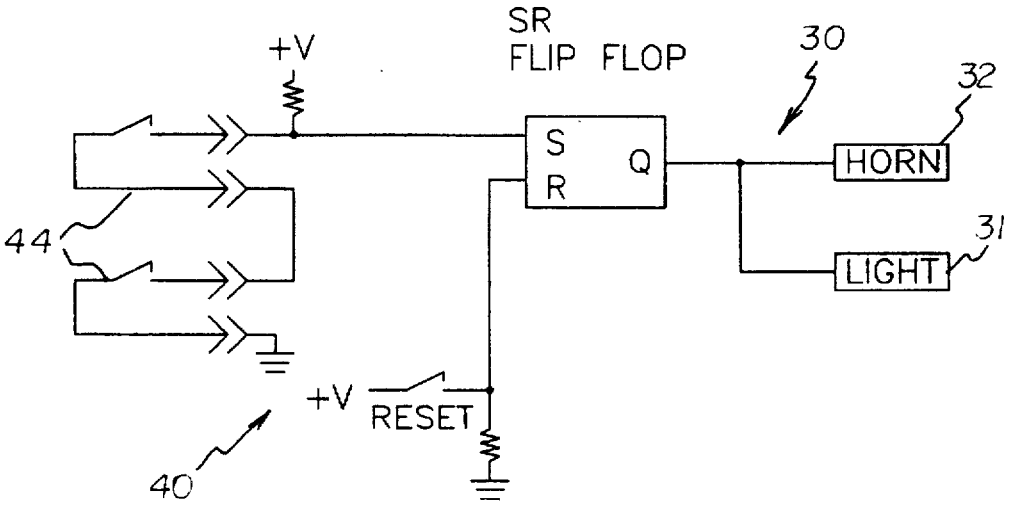
FIG 5

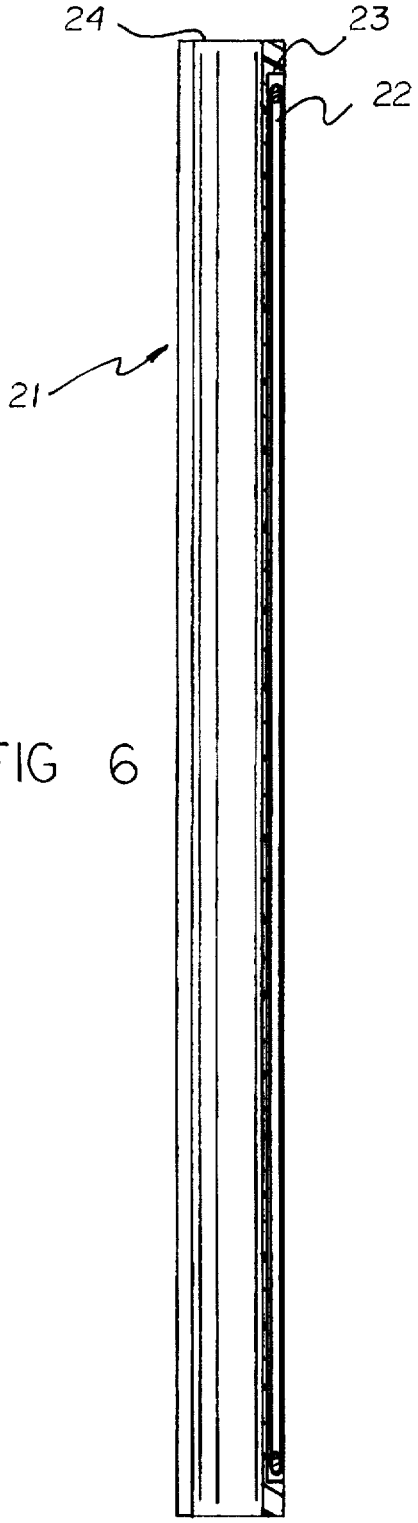
FIG 6
FIG 7
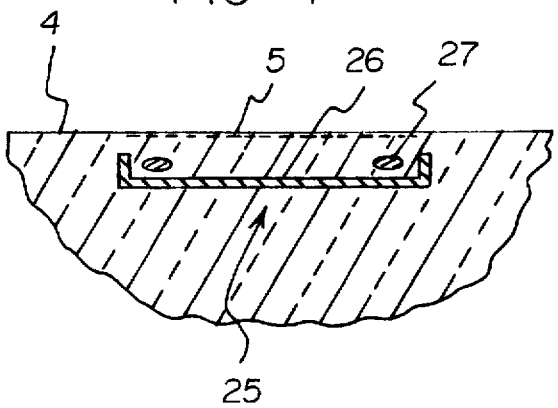

ELECTRONIC GOAL DETECTOR

BACKGROUND OF THE INVENTION

1. Field of the Invention

The present invention relates to goal detection devices and more particularly pertains to a new electronic goal detector for accurately detects and signals when a hockey puck passes through the goal line between the goal posts of a hockey goal.

2. Description of the Prior Art

The use of goal detection devices is known in the prior art. More specifically, goal detection devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art goal detection devices include U. S. Pat. No. 4,064,528; U.S. Pat. No. 5,227,764; U.S. Pat. No. Des. 353,426; U.S. Pat. No. 5,059,944; U.S. Pat. No. 4,155,078; U.S. Pat. No. 4,621,258; and 5,615,880.

A problem arising from the prior art goal detection devices is that the goal detecting sensors are general positioned at a distance from the playing surface while the ball or puck often passes through the goal while traveling on or very near the playing surface.

While these devices fulfill their respective, particular objectives and requirements, the aforementioned patents do not disclose a new electronic goal detector. The inventive device includes a set of goal sensors for mounting on the goal posts and cross bar of a hockey goal to act as a goal sensing means for detecting a puck passing through the goal line. A goal sensor is also embedded within the hockey playing surface along the goal line. At the bottom end of one of the goal posts is a two-part connector that separates when the hockey goal is moved off of the goal line to deactivate the goal sensors. A sound generating device and a light source provide an indicating means for indicating when a puck passes into the hockey goal.

In these respects, the electronic goal detector according to the present invention substantially departs from the conventional concepts and designs of the prior art, and in so doing provides an apparatus primarily developed for the purpose of accurately detects and signals when a hockey puck passes through the goal line between the goal posts of a hockey goal.

SUMMARY OF THE INVENTION

In view of the foregoing disadvantages inherent in the known types of goal detection devices now present in the prior art, the present invention provides a new electronic goal detector construction wherein the same can be utilized for accurately detects and signals when a hockey puck passes through the goal line between the goal posts of a hockey goal.

The general purpose of the present invention, which will be described subsequently in greater detail, is to provide a new electronic goal detector apparatus and method which has many of the advantages of the goal detection devices mentioned heretofore and many novel features that result in a new electronic goal detector which is not anticipated, rendered obvious, suggested, or even implied by any of the prior art goal detection devices, either alone or in any combination thereof.

To attain this, the present invention generally comprises a set of goal sensors for mounting on the goal posts and cross bar of a hockey goal to act as a goal sensing means for detecting a puck passing through the goal line. A goal sensor is also embedded within the hockey playing surface along the goal line. At the bottom end of one of the goal posts is a two-part connector that separates when the hockey goal is moved off of the goal line to deactivate the goal sensors. A sound generating device and a light source provide an indicating means for indicating when a puck passes into the hockey goal.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new electronic goal detector apparatus and method which has many of the advantages of the goal detection devices mentioned heretofore and many novel features that result in a new electronic goal detector which is not anticipated, rendered obvious, suggested, or even implied by any of the prior art goal detection devices, either alone or in any combination thereof.

It is another object of the present invention to provide a new electronic goal detector which may be easily and efficiently manufactured and marketed.

It is a further object of the present invention to provide a new electronic goal detector which is of a durable and reliable construction.

An even further object of the present invention is to provide a new electronic goal detector which is susceptible of a low cost of manufacture with regard to both materials and labor, and which accordingly is then susceptible of low prices of sale to the consuming public, thereby making such electronic goal detector economically available to the buying public.

Still yet another object of the present invention is to provide a new electronic goal detector which provides in the apparatuses and methods of the prior art some of the advantages thereof, while simultaneously overcoming some of the disadvantages normally associated therewith.

Still another object of the present invention is to provide a new electronic goal detector for accurately detects and signals when a hockey puck passes through the goal line between the goal posts of a hockey goal.

Yet another object of the present invention is to provide a new electronic goal detector which includes a set of goal sensors for mounting on the goal posts and cross bar of a hockey goal to act as a goal sensing means for detecting a puck passing through the goal line. A goal sensor is also embedded within the hockey playing surface along the goal line. At the bottom end of one of the goal posts is a two-part connector that separates when the hockey goal is moved off of the goal line to deactivate the goal sensors. A sound generating device and a light source provide an indicating means for indicating when a puck passes into the hockey goal.

Still yet another object of the present invention is to provide a new electronic goal detector that includes a goal detecting sensor embedded in the playing ice along the goal line to better detect a puck traveling on the surface of the ice past the goal line.

Even still another object of the present invention is to provide a new electronic goal detector that deactivates the goal detecting sensors when the goal posts of the hockey goal are moved or knocked off of the goal line during a hockey game.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a hockey goal with a new electronic goal detector mounted thereon according to the present invention.

FIG. 2 is a perspective view of the sensor with reflector and sensor mount.

FIG. 3 is a perspective view of the puck with a plurality of pick up means.

FIG. 4 is a circuit diagram of the goal sensing means and indicating means of the present invention.

FIG. 5 is a circuit diagram of an embodiment of the deactivation means.

FIG. 6 is a sectional view of the first sensing means sensor taken from line 6—6 of FIG. 2.

FIG. 7 is a break away sectional view of the second sensing means sensor embedded within the hockey playing surface.

DESCRIPTION OF THE PREFERRED EMBODIMENT

With reference now to the drawings, and in particular to FIGS. 1 through 7 thereof, a new electronic goal detector embodying the principles and concepts of the present invention and generally designated by the reference numeral 10 will be described.

As best illustrated in FIGS. 1 through 7, the electronic goal detector 10 comprises a set of goal sensors 22 for mounting on the goal posts 2 and cross bar 3 of a hockey goal 1 to act as a goal sensing means 20 for detecting a puck 12 passing through the goal line 5. A goal sensor 27 is also embedded within the hockey playing surface 4 along the goal line 5. At the bottom end of one of the goal posts 2 is a two-part connector 41 that separates when the hockey goal 1 is moved off of the goal line 5 to deactivate the goal sensors 22,27. A sound generating device 32 and a light source 31 provide an indicating means 30 for indicating when a puck 12 passes into the hockey goal 1.

In use, the electronic goal detector 10 is designed for use with a hockey goal 1 having a pair of spaced apart and substantially parallel goal posts 2 and an upper cross bar 3 being extended between the goal posts 2. In use during a hockey game, the hockey goal 1 is positioned along a goal line 5 of a hockey playing surface 4 such that a goal plane is formed by the goal line 5, the cross bar 3 and the goal posts 2. Typically the goal posts 2 are mounted in holes in the hockey playing surface 4. Ideally the hockey playing surface 4 is ice.

The electronic goal detector 10 includes a goal sensing means 20. The goal sensing means is designed for detecting a puck 12 passing through a goal plane of the hockey goal 1. Preferably, the goal sensing means 20 should be powerful enough to detect a puck 12 covered or blocked by material or leather such as when the puck 12 is being held within a goalie's glove.

The goal sensing means includes a first sensing means 21. The first sensing means 21 detects a puck 12 passing through the goal plane. Preferably, with reference to FIGS. 1,2,6, the first sensing means includes a plurality of sensor 22 each with a parabolic reflector 23 to make the sensors 22 directional into the goal plane area between the goal posts 2, the cross bar 3, and the goal line 5. The sensors 22 can be fixedly mounted to the goal posts 2 and the cross bar 3 or, ideally, removably mounted by sensor mounts 24.

The goal sensing means 20 also includes a second sensing means 25 that is also designed to detect when a puck 12 passes through a goal plane and has a similar directional reflector 26 to direct the sensor's 27 detection direction upwards into the goal plane. The second sensing means 25 is embedded within the hockey playing surface along the goal line 5 and positioned between the goal posts 2.

The puck 12 includes a pick up means 13. The pick up allows the puck 12 to be detected by the first sensing means 21 and the second sensing means 25 when the puck passes through the goal plane. Preferably, the pick up means 13 is a plurality of LC resonant circuits 14 having a coil portion 15 and a capacitor 16 of the type commonly used in retail stores to detect shoplifting. The coil portions 15 of the LC resonant circuits are oriented perpendicularly to each other in the x,y,z planes to insure that the puck 12 is detected by the goal sensing means 20 when it passes through the goal plane.

The electronic goal detector 10 also includes an indicating means 30. The indicating means 30 is responsive to the goal sensing means 20 so that the indicating means indicates when a puck 12 passes by the goal sensing means 20 through a goal plane.

Preferably, the indicating means 30 includes a light source 31 that is used to provide a visual indicator when the goal sensing means 20 detects a puck passing 12 through the goal plane. Also preferably, the indicating means 30 includes a sound generating means 32, such as a horn, to provide an audio indicator when the goal sensing means 20 detects a puck 12 passing through the goal plane.

The electronic goal detector also includes a deactivation means 40. The deactivation means 40 deactivates the sensing means 21,25 of the goal sensing means 20 when the hockey goal 1 is moved out of proper position and alignment on the goal line 5. This way, the electronic goal detector 10 will disconnect when the hockey goal 1 is moved so that a goal will not be improperly detected.

A preferred embodiment of the deactivation means 40 is a two part connector 41 having a first connection portion 42 located at the bottom end of one of the goal posts 2 and a second connection portion 43 that is included in the goal post mounting hole in the hockey playing surface along the goal line 5. When the hockey goal 1 is properly aligned on the goal line 5, the end of the goal post 2 fits into the mounting hole thereby connecting the two portions of the two-part connector 41. When the goal post 2 is moved out of the mounting hole and off of the goal line 5, the two-part connector 41 is separated to deactivate the goal sensing means 20.

With reference to FIG. 5, is another embodiment of deactivation means 40. In this embodiment, a goal post switch 44 is provided within both goal posts 2. The goal post switches 44 are closed when the goal posts are touching the hockey playing surface 4 and the circuit is open when either of the goal post ends 2 are lifted off of the hockey playing surface.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An electronic goal detector for a hockey goal having a pair of spaced apart and substantially parallel goal posts and an upper cross bar being extended between said goal posts, said hockey goal being positioned along a goal line of a hockey playing surface such that a goal plane is formed by said goal line, said cross bar and said goal posts, said electronic goal detector comprising:

a first sensing means for detecting a puck passing through a goal plane, said first sensing means being for mounting to a hockey goal;

a second sensing means for detecting a puck passing through a goal plane, said sensing means being for embedding within a hockey playing surface; and a deactivation means for deactivating said first sensing means and said second sensing means when the hockey goal is moved off the goal line of the hockey playing surface.

2. The electronic goal detector of claim 1, further comprising a puck having a pick up means, said pick up means being for detection by said first sensing means and said second sensing means when said puck passes through the goal plane.

3. The electronic goal detector of claim 1, wherein said first sensing means is for removable mounting to a hockey goal.

4. The electronic goal detector of claim 1, further comprising a light source, said light source being for indicating when said first sensing means and said second sensing means detect a puck passing through the goal plane.

5. The electronic goal detector of claim 1, further comprising a sound generating means, said sound generating means generating a sound when said first sensing means and said second sensing means detect a puck passing through the goal plane.

6. An electronic goal detector for a hockey goal having a pair of spaced apart and substantially parallel goal posts and an upper cross bar being extended between said goal posts, said hockey goal being positioned along a goal line of a hockey playing surface such that a goal plane is formed by said goal line, said cross bar and said goal posts, said electronic goal detector comprising:

a goal sensing means for detecting a puck passing through a goal plane including a first sensing means and a second sensing means, said first sensing means and said second sensing means for detecting a puck passing through a goal plane, said first sensing means being for mounting to a hockey goal, said second sensing means being for embedding within a hockey playing surface;

an indicating means being responsive to said goal sensing means, said indicating means being for indicating when a puck passes through a goal plane; and a deactivation means for deactivating said first sensing means and said second sensing means when the hockey goal is moved off a goal line of the hockey playing surface.

7. The electronic goal detector of claim 6, further comprising a puck having a pick up means, said pick up means being for detection by said first sensing means and said second sensing means when said puck passes through the goal plane.

8. The electronic goal detector of claim 6, wherein said first sensing means is for removable mounting to a hockey goal.

9. The electronic goal detector of claim 6, wherein said indicating means includes a light source being for visually indicating when said goal sensing means detects a puck passing through the goal plane.

10. The electronic goal detector of claim 6, wherein said indicating means includes a sound generating means being for audibly indicating when said goal sensing means detects a puck passing through the goal plane.

* * * * *